United States Patent [19]

Jorgensen, deceased et al.

[11] 4,109,606

[45] Aug. 29, 1978

[54] SELF-ENERGIZED ALARM DEVICE

[76] Inventors: Clarence W. Jorgensen, deceased, late of Gurnee, Ill.; by Elva Mae Jorgensen, executrix, 5023 Darlene Dr., Gurnee, Ill. 60031

[21] Appl. No.: 811,895

[22] Filed: Jun. 29, 1977

[51] Int. Cl.[2] ..... G08B 3/02

[52] U.S. Cl. ..... 116/94

[58] Field of Search ..... 116/94, 91, 86, 85, 116/81, 100; 340/274, 276

[56] References Cited

U.S. PATENT DOCUMENTS 773,165 10/1904 Smith ..... 116/100

1,562,067 11/1925 Sprouse ..... 116/94

*Primary Examiner*—S. Clement Swisher
*Assistant Examiner*—Denis E. Corr
*Attorney, Agent, or Firm*—Neil E. Hamilton

[57] ABSTRACT

A self-energized alarm device which can signal unauthorized entry such as through a doorway or window. The alarm device is preferably energized by a spring mechanism and utilizes a bell which is activated by means of an arm member and vibrated by an escapement. A standard slide bolt door latch is incorporated in the alarm device as a means for actuating the arm member.

10 Claims, 5 Drawing Figures

FIG. 1.
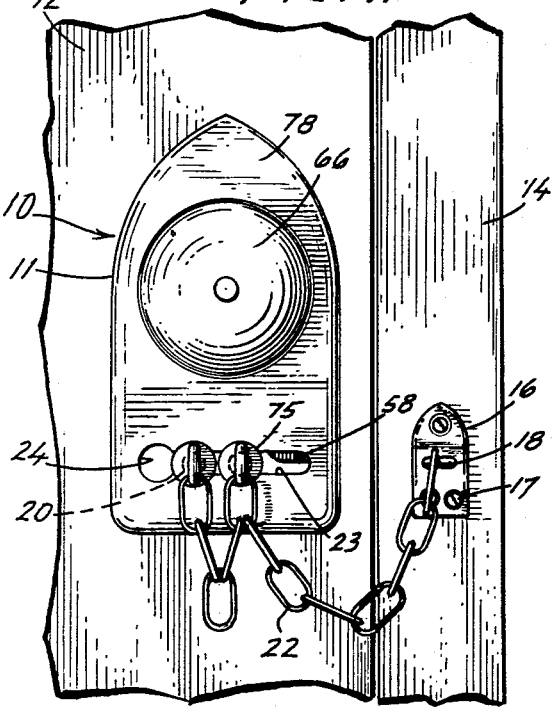
FIG. 2.
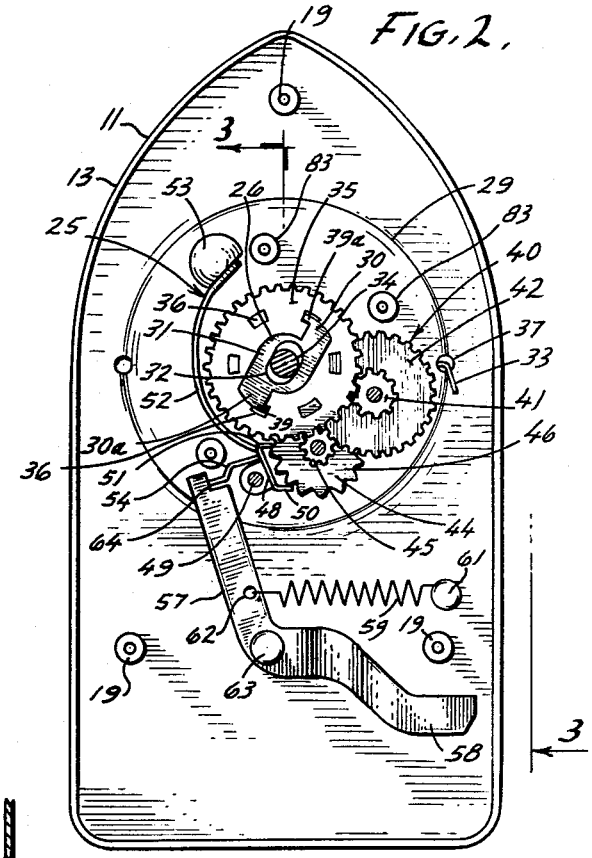
FIG. 3.
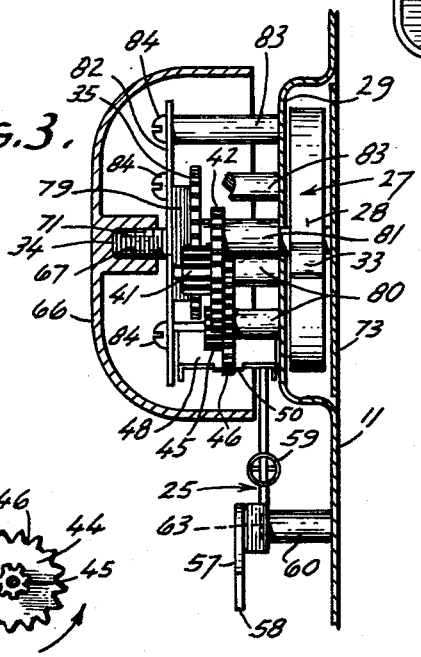
FIG. 4.
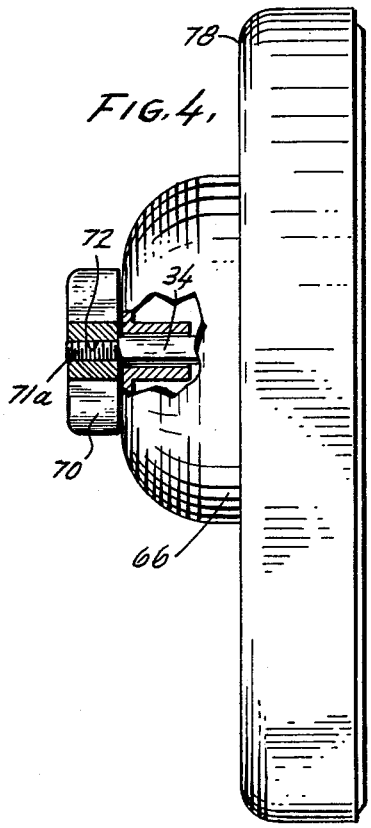
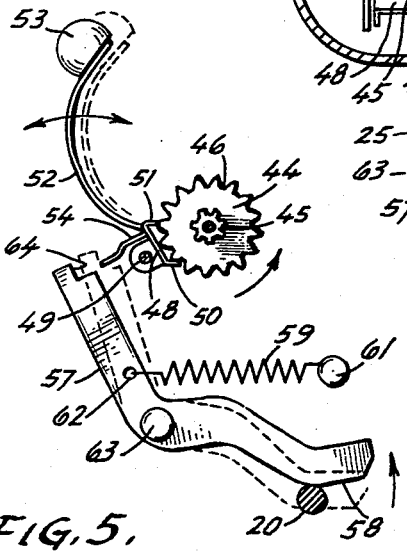
FIG. 5.

SELF-ENERGIZED ALARM DEVICE

BACKGROUND OF THE INVENTION

This invention relates to an alarm device which can signal an unauthorized entry into an enclosure such as a building or a vehicle. More particularly, this invention relates to a self-energized alarm unit which operates independently of an external power source and can be activated by means of a standard slide bolt for a door latch.

Alarm devices of the type concerned with in this invention are described in U.S. Pat. Nos. 3,340,522; 3,406,386; 3,444,546; 3,553,721; 3,569,950; 3,585,625; 3,560,952 and 3,714,644. All of the devices described in these patents utilize an electrical power source such as a battery. These types of energized alarm devices can and do pose problems from a dependability standpoint in that the source of electrical power can fail, such as a battery going dead without knowledge of the user. A vibration sensing component is described in U.S. Pat. No. 3,340,522 and whereas a biased switch housing is utilized in U.S. Pat. No. 3,406,386 and 3,553,721. In U.S. Pat. No. 3,444,546 a specific circuitry or key lock mechanism is utilized, and in U.S. Pat. No. 3,569,950 a slide bolt alarm is indicated for use with a resilient arm and an electrical circuit. The same general type of slide bolt electrical combination is described in U.S. Pat. No. 3,585,625, and a sepcific guide member is utilized in U.S. Pat. No. 3,560,952. A slide bolt alarm device is portrayed in U.S. Pat. No. 3,714,644 in combination with a latch mechanism having a flexible conductive member.

The prior art nowhere teaches an alarm device which is operable without the use of electrical potential and is self-energized. Neither is there available an alarm device which is energized by a spring biasing means in combination with a slide bolt latch mechanism. The prior art provides alarm mechanisms which utilize electrical circuitry and specific mechanisms for use in combination with the circuitry or specific actuating components.

It is an advantage of the present invention to provide an alarm device which can be self-energized. Other advantages are: an alarm device which is operable in combination with a door slide bolt latch mechanism; an alarm device which will operate without the use of electrical energy, and a combined latch and alarm unit which can be fabricated from standard component parts and thus is economical to manufacture.

SUMMARY OF THE INVENTION

The foregoing advantages are accomplished and the shortcomings of the prior art are overcome by the present alarm unit wherein a housing member means is provided to be preferably mounted on a movable door and an anchor means is preferably mounted on a stationary doorway. A contact is movably carried by the housing member and linkage means connects the contact means with the anchor means. An alarm member is carried by the housing member and includes a biasing means with means to maintain the biasing means under tension and to release tension on said biasing means. A striker arm member is interconnected to said biasing means in a manner such that a reciprocating movement of the striker arm member is effected upon release of the tension of the biasing means. A sound producing element is carried by the housing member and contacted by the striker arm member. The means to release the tension includes an actuating element having a portion for temporarily interfering with the contact means. In a preferred manner, the sound producing element is a cup member to produce a bell with a striker arm. The contact means is afforded by a slide bolt and a slide track in the housing with the bolt contacting a portion of an actuating arm for releasing tension on the biasing means under predetermined tension conditions. Further, two bolt members can be provided as an adjustment means for more sensitive actuation.

BRIEF DESCRIPTION OF DRAWINGS

A better understanding of the present alarm unit will be had by reference to the drawing wherein:

FIG. 1 is a view in side elevation of the alarm unit shown mounted on a door and doorway which are partially shown;

FIG. 2 is a view in side elevation of the alarm unit with the cover and other portions and elements removed to illustrate the gear train and actuating mechanism;

FIG. 3 is a view in vertical section taken along line 3—3 of FIG. 2;

FIG. 4 is a side view in side elevation illustrating an alternative embodiment, and FIG. 5 is a partial showing of the escapement and actuating element in an operative and inoperative position.

DESCRIPTION OF THE PREFERRED EMBODIMENTS

Proceeding to a detailed description of the invention, the self-energized alarm, warning device is generally indicated by the numeral 10 and includes a housing 11 mounted on a movable door member 12. An anchor means 16 is secured to stationary door frame 14 by means of ordinary screws 17. A loop 18 is provided on anchor 16 and affords attachment for linkage means in the form of chain 22. A slide bolt 20 is connected to the opposite end of the chain for slidable engagement in slide track 23 in the usual manner. An enlarged opening 24 is disposed in track 23 for the normal enlarged back portion (not shown) of bolt 20.

As best seen in FIGS. 2 and 3, the alarm member generally 25 includes a biasing means 27 generally in the form of a coil spring 28 enclosed in housing 29 with one end 33 secured in housing opening 37. Spring 28 is also attached to post 34 by means of a tab portion (not shown) inserted therein in the usual manner. Also secured to post 34 is a spring tensioning ratchet 26 having two arms 30 and 30a radially extending from a central portion 31 having an elliptical configuration 32 for non-rotatable contact with post 34 also having a complementary elliptical portion. Ratchet arms 30 and **30*a* have projecting flanges 39 and 39*a* for directional slip engagement in openings 36 of drive gear 35. Washers 79 are placed between a cover plate 82 and ratchet 26 for intermittently holding flanges 39 and 39*a* in gear openings 36. A pivotal gear 40 is rotatably disposed adjacent drive gear 35 and has a small diameter portion 41 for engagement with drive gear 35. A large diameter portion 42 also comprises pivotal gear 40 for meshing with a small diameter portion 45 of striker arm drive gear 44 which also has a large diameter portion 46**.

A substantially U-shaped escapement means 48 is pivotally secured to post 49 in the normal manner and has two parallel arms 50 and 51 for engaging gear portion 46. Also extending from escapement means 48 is striker arm 52 with striker head 53. A bar 54 also extends from escapement 48 for engagement with brake and actuating arm 57 by means of contact cutout portion 64. Arm 57 is pivotally secued to post 60 by means of a central cap portion 63. A tension spring 59 engages arm 57 by means of opening 62 and is secured at its opposing end by means of opening 61 in housing 11. A hollow metal vessel 66 in the form of a bell cup is of a size to be grapsed by a human hand and has internal threads 67 for securing to external threads 71 on post 34. Post 34 extends through plate 82 and is pivotally secured to base plate 73 which is attached to housing 11 with post 34 centrally positioned within spring 28. Gear posts 80 provide the pivotal attachment and spacing for gears 35, 40 and 44 whereas posts 83 afford attachment for plate 82 by means of screws 84. Post 81 affords pivotal spacing for gear 35 with post 34 extending therethrough.

As best seen in FIG. 4, if desired, a turn key member 70 is threaded directly to post 34 with internal threads 72 engaging post threads 71*a*. Post 34 is journaled through bell cup 66 to afford winding of spring 28 without turning of cup 66. By a suitable threaded engagement, cup 66 will be loosely retained on post 34.

Referring to FIG. 5, the braking and activation of the escapement 48 is particularly shown. When actuating arm 57 is in its broken line position, it will serve to engage escapement bar 54 by contact with contact portion 64. This will prevent movement of striker arm gear 44. When engagement portion 58 of arm 57 is contacted by bolt 20, arm 57 will be moved in a counterclockwise manner to assure a solid line positon. This places contact portion 64 out of engagement with escapement bar 54 and permits escapement 48 to vibrate striker arm 52 and head 53 as shown in solid and broken lines, which vibration will be explained later in the Operation.

OPERATION

A better understanding of the advantages of the alarm device 10 will be had by a description of its operation. Housing member 11 will be mounted on door 12 by means of screws placed through holes (not shown) in housing 11. Cover 78 will be placed over housing base 13 and form a portion of housing 11 and will be spaced therefrom by posts 19. Bell cup 66 will then be screwed onto post 34 by means of threads 67 and 71. Anchor 16 will be secured to frame 14 by means of screws 17.

When it is desired to activate alarm member 25, bell cup 66 will be grapsed by one's hand and turned in a clockwise manner to wind spring 28, as post 34 will turn when threads 67 are fully engaged. The continued turning will wind the spring and effect a biasing effect on post 34 and gear 35 by ratchet flanges 39, 39*a* in gear openings 36. The engagement of ratchet arms 39 and 39*a* in gear openings 36 is such that arms 30, 30*a* will disengage and ride from opening to opening when post 34 is rotated in a clockwise manner but will engage when the winding rotation is stopped and effect a spring tension on post 34 in a counterclockwise motion. Unwinding of spring 28 is prevented by the teeth of striker arm drive gear portion 44 engaged by escapement arm 51. This braking or means to maintain the biasing means under tension is effected by the gear train provided by small diameter gear portion 45 meshing with large diameter portion 42 of pivotal gear 40 and small diameter portion 41 of gear 40 engaging drive gear 35. Escapement 48 will be held against gear portion 46 in a biased manner by contact portion 64 of biased arm 57 contacting escapement bar 54. Escapement 48 through the positioning of arms 50 and 51 will also prevent gear 44 as well as gear 35 from turning during the winding operation.

After the spring 27 is placed under suitable tension, slide bolt 20 will be inserted in slide track 23 by first placing it through enlarged opening 24 with door 12 suitably positioned. With bolt 20 placed in track 23, any movement of door 12 away from frame 14 will cause bolt 20 to slide in track 23 in the direction opposite enlarged opening 24. Referring to FIG. 5, as bolt 20 continues to travel, it will contact engagement portion 58 of arm 57. This engagement will cause arm 57 to pivot away from escapement bar 54. This release of tension on escapement 48 will allow striker arm drive gear 44 to rotate in a counterclockwise manner. Due to the positioning of escapement 48, the teeth of gear 44 will effect a camming action on arm 51 and permit it as well as arm 50 to ride over the teeth on the large diameter portion 46 of gear 44 and effect a rocking or rotational effect. Gear 44 will be driven through the gear train drive of drive gear 35 driving pivotal gear 40 which in turn drives striker arm gear 44. As gear 44 turns, escapement 48 will vibrate and afford the means to connect the striker arm 52 with the biasing means as previously described. This vibration will be transmitted to striker arm 52 and head 53 which will strike and cause a ringing action on bell cup 66, as cup 66 is positioned to be so contacted when arm 52 is in an extended position as shown in full lines in FIG. 5. This will effect a bell warning alarm should anyone attempt to open door 12 without authorization.

If desired, and to facilitate ease of winding, a key 70 can be threaded directly on post 34. Alternatively, a key can be integrally placed on bell cup 66. It should also be noted that a second slide bolt 75 is secured to chain 22. This is for the purpose of providing adjustment and effecting a more sensitive setting as less travel will be required before contact is made with engagement portion 58 of arm 57.

While a specific form of a gear train is indicated, there is nothing critical in the gear ratios or their numbers. Likewise, any manner of spring 27 engaging post 34 could be utilized as well as a means of providing winding engagement between post 34 and ratchet arms 30, 30*a* as well as drive gear 35. While alarm unit 10 has been shown for use with a door and frame, it can be operated in conjuction with a window by placing anchor 16 on the window frame and housing 11 on the surrounding molding or wall.

It will thus be seen that through the present invention there is provided a self-energized alarm device which does not require electrical potential for its operation. The alarm device of this invention is simple in its construction and can be fabricated without special parts or tooling. Alarm unit 10 is easily energized, can be utilized in conjunction with a door as well as with a window and can be adjusted for sensitive operation.

The foregoing invention can now be practiced by those skilled in the art. Such skilled persons will know that the invention is not necessarily restricted to the particular embodiments presented herein. The scope of the invention is to be defined by terms of the following claims as given meaning by the preceding description.

I claim:

1. A self-energized alarm device operable between a movable and a stationary member comprising:

means defining a housing member for mounting on said movable or on said stationary member;

anchor means for mounting on said movable or said stationary member opposite said housing member;

contact means movable carried by said housing member;

linkage means connecting said contact means with said anchor means;

an alarm member carried by said housing, said alarm member including:

biasing means;

means to activate said biasing means;

means to maintain said biasing means under tension and to release said tension on said biasing means;

a striker arm member;

means to operatively connect said striker arm member with said biasing means to effect a reciprocating movement of said striker arm member upon release of said tension of said biasing means;

a sound producing element carried by said housing member and constructed and arranged to be contacted by said striker arm member;

said means to maintain said biasing means under tension and to release said tension including an actuating element having a portion positioned for temporarily interfering relation with respect to said contact means, so that when a predetermined tension is placed on said linkage means, said contact means contacts said portion of said actuating element to release said tension on said biasing means and activate said striker arm member to contact said sound producing element.

2. The self-energized alarm device as defined in claim 1 wherein said sound producing element is defined by a hollow metal vessel to provide with said striker arm member a bell unit.

3. The self-energized alarm device as defined in claim 2 wherein said biasing means is a spring member and said means to activate said spring includes a key member.

4. The self-energized alarm device as defined in claim 2 wherein said means to maintain said biasing means under tension and to release said biasing means as well as to operatively connect said biasing means with said striker arm is a gear train and escapement mechanism.

5. The self-energized alarm device as defined in claim 2 wherein said hollow metal vessel is provided by a cup member of sufficient size to be grasped by a human hand so that a turning of said cup member will effect an actuating of said biasing means.

6. The self-energized alarm device as defined in claim 1 wherein said contact means is defined by a slide bolt member and a slide track is disposed in said housing for captively holding said bolt member in a sliding manner, and said actuating element portion is positioned for interfering relation with respect to said bolt member's travel along said track.

7. The self-energized alarm device as defined in claim 6 wherein said linkage means is defined by a chain member.

8. The self-energized alarm device as defined in claim 7 wherein said bolt member is adjustable at various positions on said chain member.

9. The self-energized alarm device as defined in claim 8 wherein at least two bolt members are positioned on said chain member.

10. The self-energized alarm device as defined in claim 6 wherein said actuating element is defined by a spring-tensioned, pivotally mounted arm member.

* * * * *